US005551272A

United States Patent [19]

Knudson

[11] Patent Number: 5,551,272

[45] Date of Patent: Sep. 3, 1996

[54] HALF-ROUND GUTTER MAKING APPARATUS

[76] Inventor: Gary A. Knudson, 17356 W. 57th Ave., Golden, Colo. 80401

[21] Appl. No.: 522,699

[22] Filed: Sep. 1, 1995

Related U.S. Application Data

[63] Continuation of Ser. No. 230,314, Apr. 20, 1994, abandoned.

[51] Int. Cl.[6] ..... B21D 5/08

[52] U.S. Cl. ..... 72/181

[58] Field of Search ..... 72/181, 182, 178, 72/176, 51, 52

[56] References Cited

U.S. PATENT DOCUMENTS

| | | | |
|---|---|---|---|
| 2,458,906 | 1/1949 | Himmel | 72/178 |
| 2,826,235 | 3/1958 | Gudmestad | 72/178 |
| 4,899,566 | 2/1990 | Knudson | 72/181 |
| 4,947,671 | 8/1990 | Lindstrom | 72/52 |

FOREIGN PATENT DOCUMENTS

| | | | |
|---|---|---|---|
| 179464 | 9/1954 | Austria | 72/181 |
| 31329 | 1/1923 | Denmark | 72/181 |
| 617062 | 8/1935 | Germany | 72/181 |
| 881334 | 6/1953 | Germany | 72/181 |
| 147117 | 6/1990 | Japan | 72/52 |

*Primary Examiner*—Daniel C. Crane
*Attorney, Agent, or Firm*—Ancel W. Lewis, Jr.

[57] ABSTRACT

Roll forming apparatus is disclosed for making half-round gutters and the like includes a series of initial forming stations that roll form a partially formed curved bottom wall, and opposed front and rear walls with a conventional ogee curve and head in the front wall and a hook in the back wall. An adjustably positionable side roller assembly receives the gutter body and while completing the head grips the head and moves the front wall and associated top edge toward the opposite rear wall and associated top edge. A hook forming assembly opposite the side forming assembly balances and stabilizes the gutter body and turns the top edge of the back wall toward the front wall. Two over bending stations after the side roller assembly and hook forming assembly grip the head and hook and overbend the bottom wall to a smaller radius and the opposed walls past a parallel position so the resiliency causes the bottom and opposed walls to spring back to a desired size and shape in the finally formed half-round gutter.

14 Claims, 5 Drawing Sheets

HALF-ROUND GUTTER MAKING APPARATUS

This application is a continuation of application Ser. No. 230,314, filed Apr. 20, 1994, now abandoned.

TECHNICAL FIELD

This invention generally relates to apparatus for making shaped members from a sheet material and more particularly to apparatus suitable for making half-round gutters and the like from sheet metal.

BACKGROUND ART

There are a variety of shaped members that are formed from sheet metal coil stock using a plurality of successive forming stations. Prior art practice for making gutters with a semi-circular intermediate or base wall and parallel side walls, commonly referred to as "half-round" gutters, has been to use an upper roller with a semi-circular shaped surface and with parallel sides and a semi-circular shaped lower roller but are constructed without the ability to overbend the bottom and front and rear walls as is described more fully hereinafter. In U.S. Pat. No. 4,899,566 having the same inventor as the present application there is disclosed apparatus for making flat bottom wall gutters using an upper roller on a center mount depending from a top cross-support member.

DISCLOSURE OF THE INVENTION

In accordance with the present invention there is provided a roll forming apparatus which has a series of roll forming stations that make a partially formed gutter body from flat sheet metal. A box-like side roller assembly and an opposite hook forming assembly form the head and hook and converge the top edges. The last two roll forming stations overbend and hold the partially formed gutter body in an overbent condition with the resiliency of the material allowing the gutter to spring back to a preselected size and shape for providing the final gutter. Each of the last two forming stations have an upper roller of a generally spherical shape and a concave lower roller that bend the bottom wall to a smaller radius than the preselected radius of the final gutter and at the same time have at least one rear side roller for the back wall and a roller set for the front wall overbend the opposed walls of the gutter body past a parallel relation to a converging relation with the resiliency of the material causing the bottom and opposed walls of the gutter to expand and spring back to a preselected size and shape for the final gutter. In several of the intermediate forming stations the upper rollers are two semi-spherical roller sections on opposite sides of a vertical center line preferably made of plastic. The last two stations have two semi-spherical roller sections disposed at a selected angle to a vertical center line so there is no gap between the roller sections in contact with the sheet metal.

BRIEF DESCRIPTION OF THE DRAWINGS

Details of this invention are described in connection with the accompanying drawings which like parts bear similar reference numerals in which.

DETAILED DESCRIPTION

Figure 1:
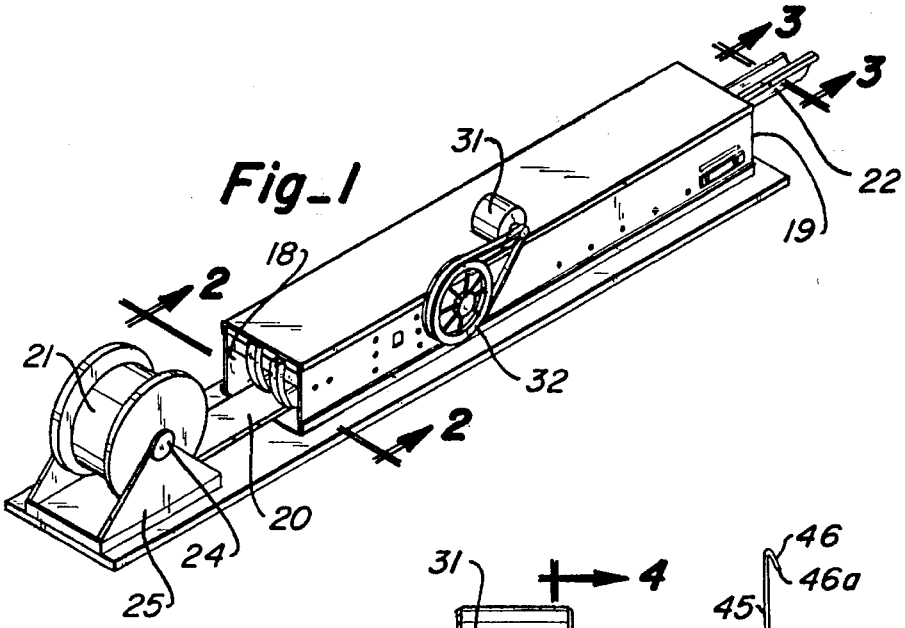
FIG. 1 is a perspective view of apparatus for making half-round gutters embodying features of the present invention.
Figure 2:
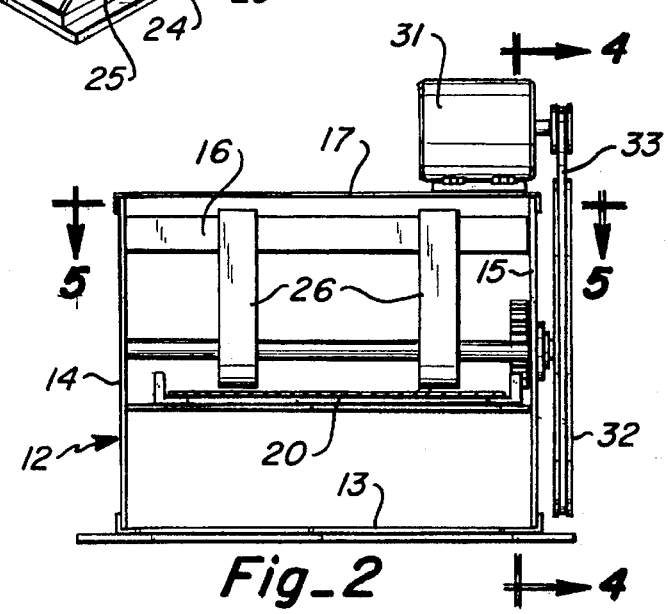
FIG. 2 is a sectional view taken along line 2—2 of FIG. 1 showing the input end of the apparatus with sheet metal shown entering the apparatus.
Figure 4:
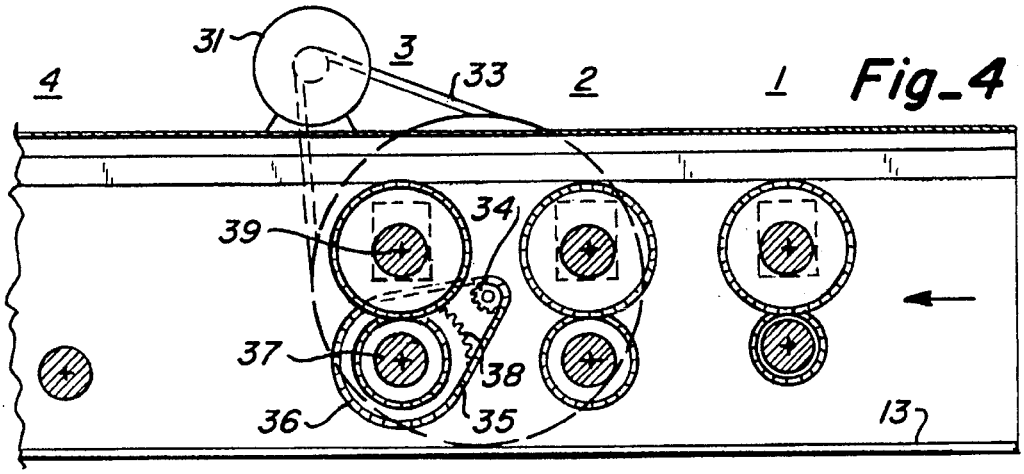
FIG. 4 is a sectional view taken along line 4—4 of FIG. 2 showing the motor and a portion of the drive system to the forming rollers of the nine stations.

Referring now to FIGS. 1, 2 and 4 there is shown roll forming apparatus particularly suited for making half-round gutters which in general includes a generally rectangular support housing or frame 12 having a base plate 13, a pair of spaced, opposed side plates 14 and 15 and a plurality of top cross support members 16 at spaced intervals along the frame 12 connected between the tops of the side plates and a cover plate 17 closing the top. A series of nine roll forming stations designated by numerals 1 to 9 described hereinafter are provided at selected spaced intervals along and within the housing 12 between an upstream feed or entry end 18 and a downstream discharge or exit end 19.

Flat sheet metal 20, preferably sheet metal stock provided in a large roll 21, enters the apparatus in a feed end 18 and a formed gutter 22 exits the discharge end. The roll 21 is mounted on a shaft 24 supported for rotation on a frame 25 so the sheet metal 20 moves continuously through the forming apparatus. The formed gutter 22 exits the discharge end 19 and is cut to the desired length by a suitable cutting assembly (not shown). At the entry end 18 a pair of spaced entry guides 26 guides the sheet metal into the first station 1.

Figure 6:
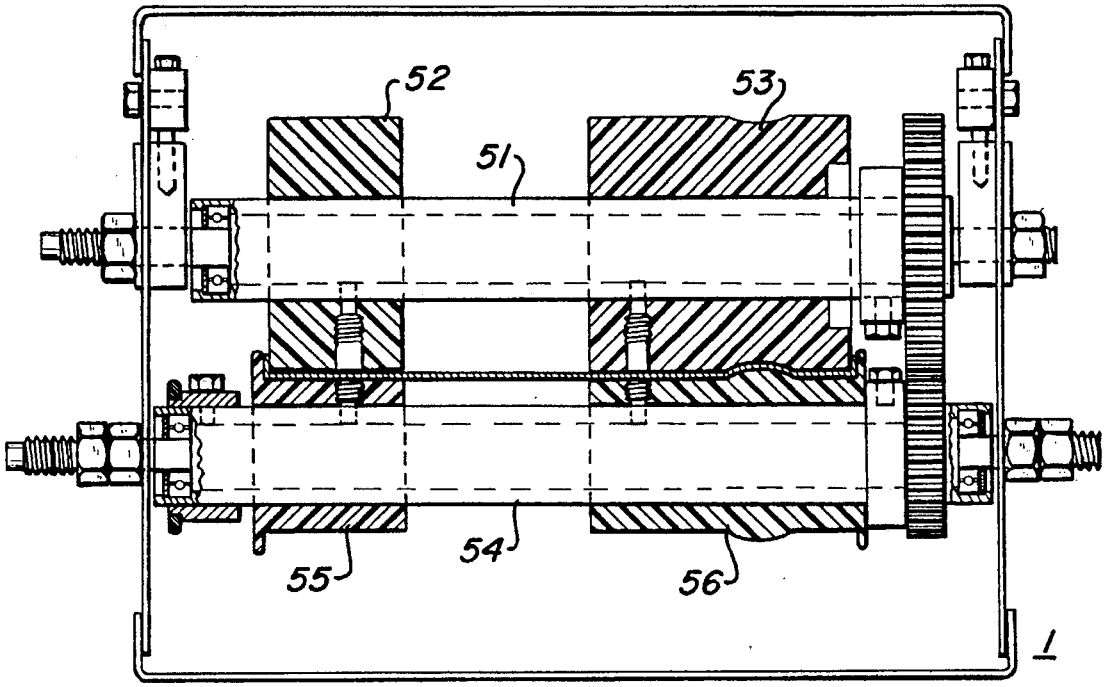
FIG. 6 is a sectional view taken along line 6—6 of FIG. 5 showing station 1.
Figure 7:
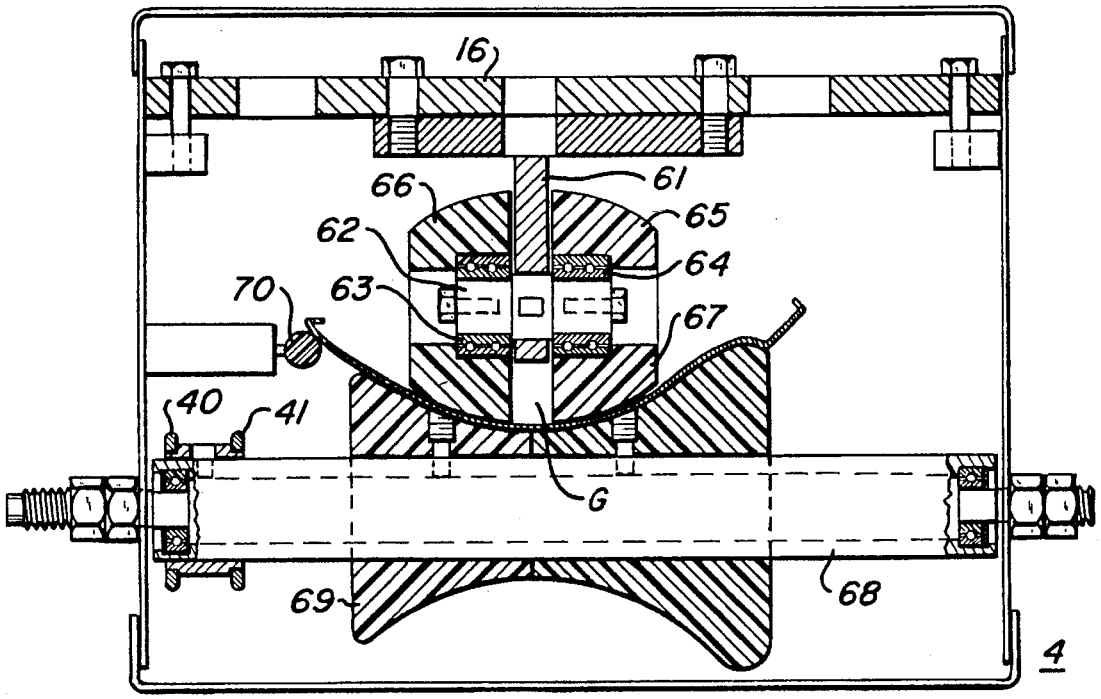
FIG. 7 is a sectional view taken along line 7—7 of FIG. 5 showing station 4.

The drive for the assembly includes a motor 31 mounted on top of the frame which drives a main sprocket 32 via a belt 33. The main sprocket 32 has a gear 34 coupled by a chain 35 to a gear sprocket 36 on the shaft 37 for the lower roller of the third station 3. The lower roller shaft has a gear 38 meshing with a gear on the associated upper roller shaft 39 on the front end of the associated shaft, so the movement of the upper and lower rollers of each station is synchronized. The meshing lower and upper gears are seen in FIG. 6. Each lower shaft of each station except the first and last stations has a pair of gears 40 and 41 on the back end of the associated shaft as seen in FIG. 7 that are coupled by a chain to a lower gear on a lower shaft of an adjacent station, one of the gears 40 is chained to the next lower gear toward the exit end and the other one 41 is chained to the next lower gear toward the entry end. In this way all of the lower shafts of each of stations 1–9 are driven by the rotation of the lower shaft 37 at the third station by power supplied via the main sprocket 32.

Figure 3:
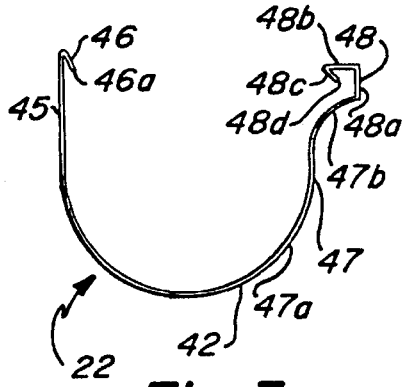
FIG. 3 is a sectional view taken along line 3—3 of FIG. 1 showing the cross section of the half-round gutter produced by the apparatus shown in FIGS. 1 and 2.

The formed final gutter 22 shown in FIG. 3 has a half-round or semi-circular bottom wall 44, a back wall 45 with an inturned hook 46 at the top and terminating in back edge 46*a* and a front wall 47 opposite the back wall 45. The front wall 47 has the conventional ogee shape with a head 48 at the top. The ogee curve has a lower portion 47*a* along the radius established by the radius of the upper roller and an upper portion 47*b* that extends laterally out to connect to the head 48. The head 48 has a front section 48*a* parallel to the back wall, a top section 48*b* turned inwardly toward the back wall and a hook 48*c* turned down and out at an angle of about 45 degrees and terminates in front edge 48*d*.

Figure 9:
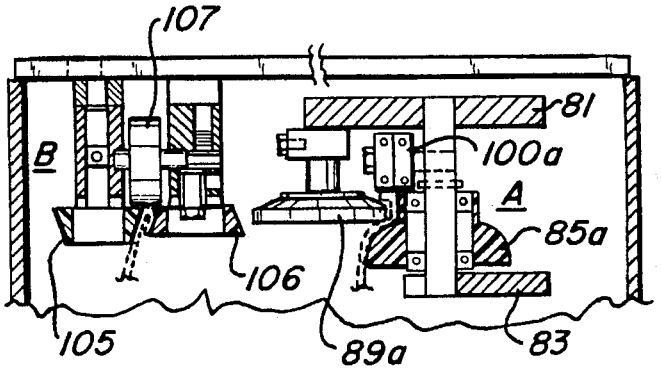
FIG. 9 is a sectional view taken along line 9—9 of FIG. 5 showing parts of assemblies A and B.
Figure 5:
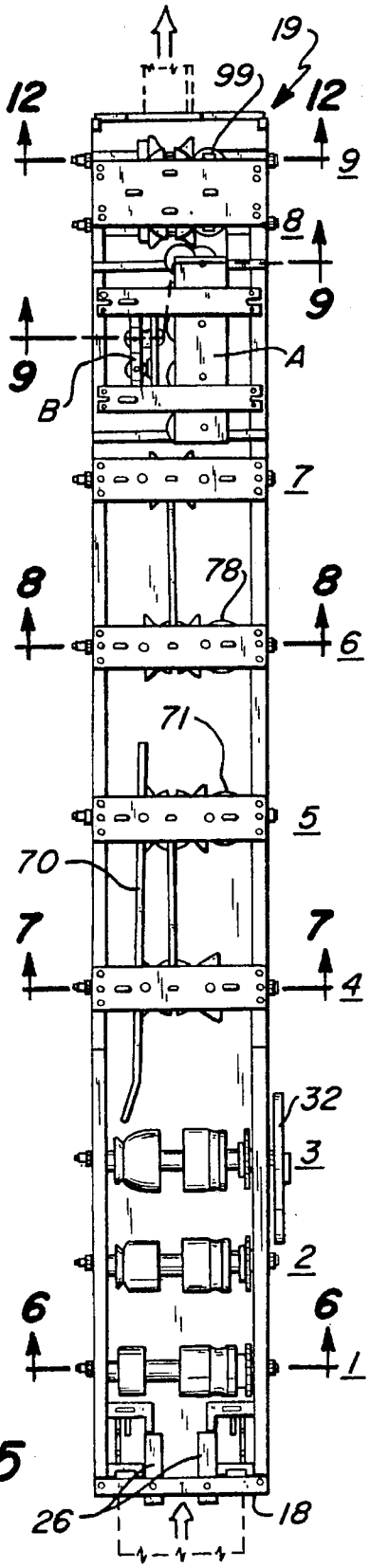
FIG. 5 is a sectional view taken along line 4—4 of FIG. 2 showing a top plan view of the apparatus below the top cover.
Figure 10:
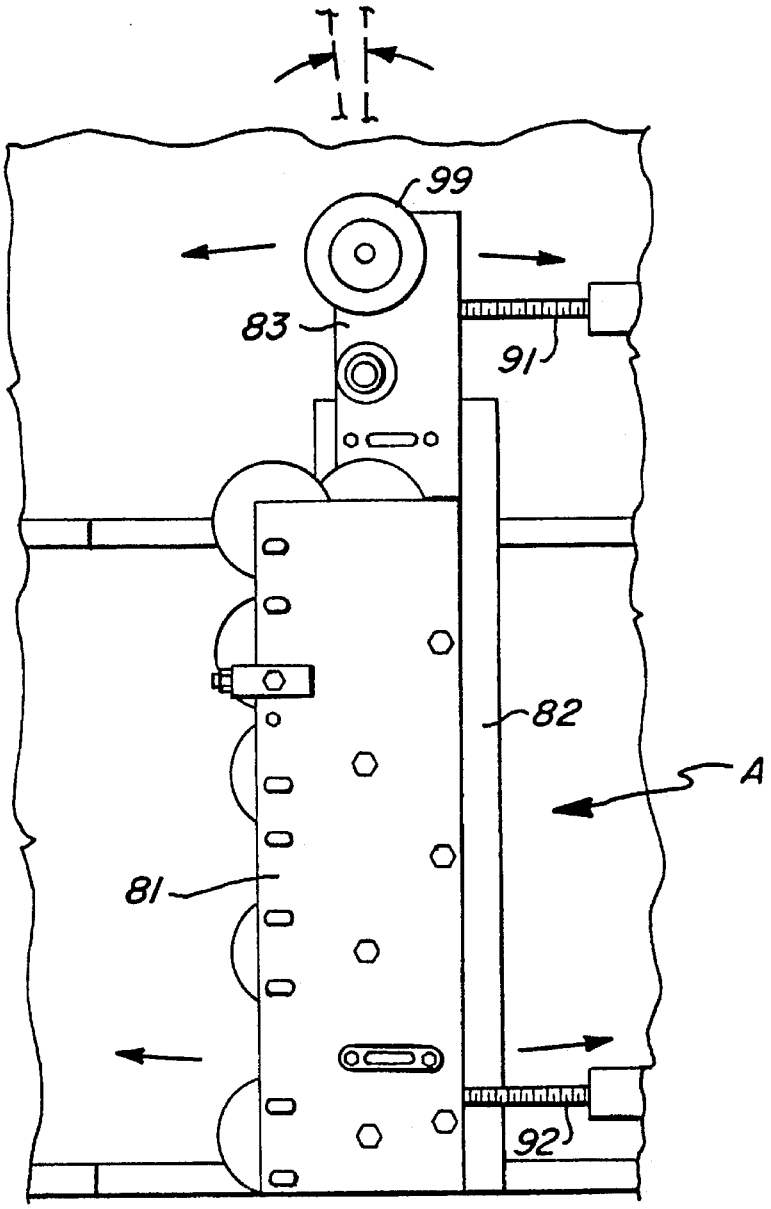
FIG. 10 is an enlarged top plan view of assembly A.
Figure 11:
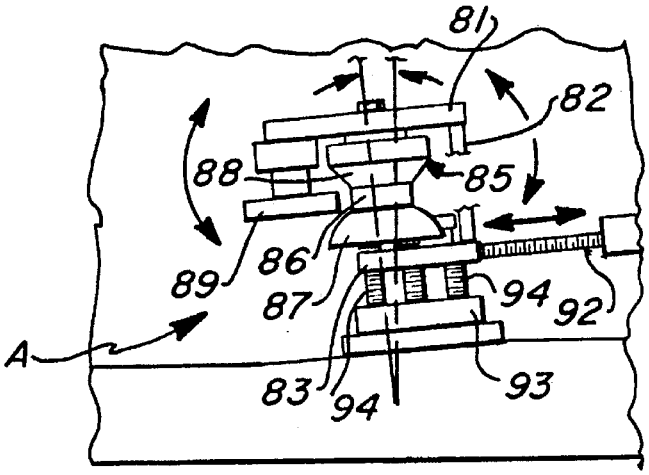
FIG. 11 is an end elevational view of assembly A.
Figure 8:
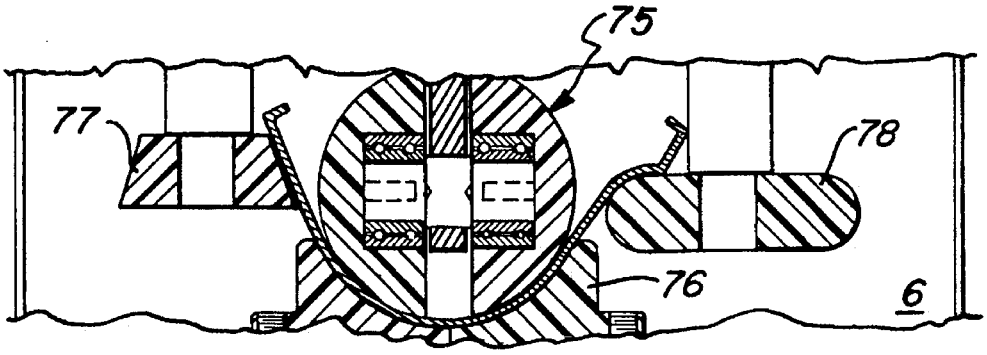
FIG. 8 is a sectional view taken along line 8—8 of FIG. 5 showing station 6.
Figure 12:
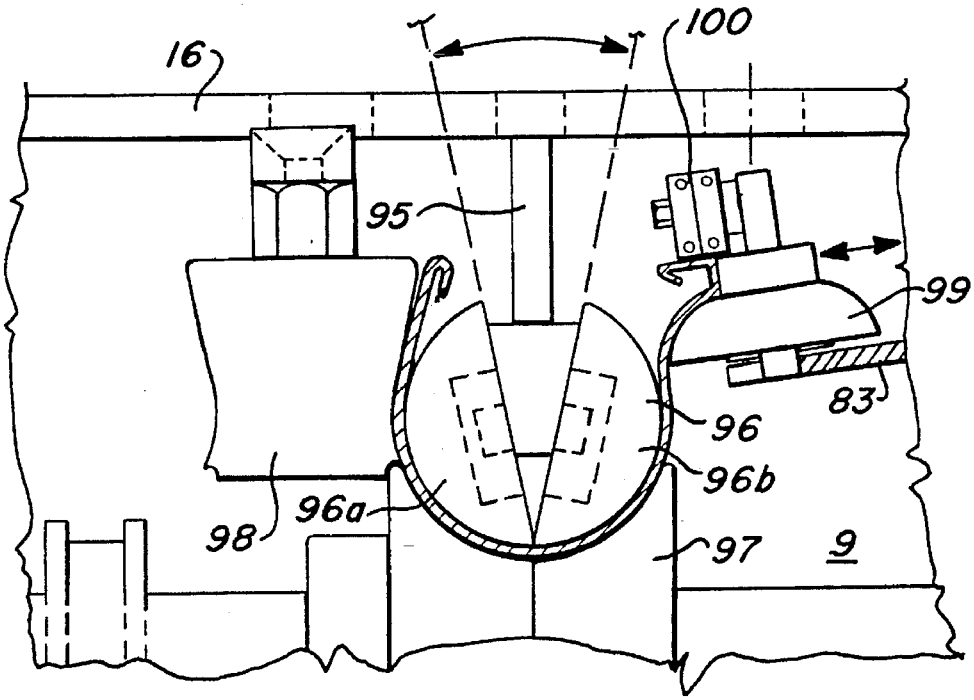
FIG. 12 is a view taken along line 12—12 of FIG. 5 showing station 9 showing only the outline of the parts.

In general, as best seen in FIG. 5, the first three stations 1, 2, and 3 shown in FIGS. 6, 7 and 8 are substantially the same. The next two stations 4 and 5 shown in FIGS. 9 and 10 are substantially the same. Stations 6 and 7 shown in FIGS. 11 and 12 are substantially the same. A box-like side roller assembly A and a hook forming assembly B opposite assembly 29 are provided between the seventh and eighth stations 7 and 8. Stations 8 and 9 are similar.

Referring to FIG. 6 station 1 is shown to have an upper shaft 51 on which there is supported two axially spaced roller sections 52 and 53 for conjoint rotation with the shaft 51 and a lower shaft 54 on which two axially spaced lower roller sections 55 and 56 are mounted for conjoint rotation with lower shaft 54. This station begins the hook in the back wall and the formation of the ogee curve and the head in the front wall. The next two stations 2 and 3 are similar to the first station and have more pronounced curved sections that progressively turn in the opposed front and rear walls toward one another.

Referring to FIG. 7 station 4 is shown to have a central skate-type mount which includes a central depending support member 61 mounted to and extending down from an intermediate position of the top cross support member 16. A shaft 62 is mounted on the central depending support member 61 and projects beyond opposite ends. Bearings 63 and 64 are mounted on opposite end portions of the shaft 62. An upper roller 65 is provided by a pair of opposed, semi-circular roller sections 66 and 67 mount on the bearings 63 and 64, respectively, on opposite sides of a vertical center line through the depending support member 61 with a gap G shown at a bottom center position. The roller sections 66 and 67 shown preferably are plastic. A nylon material sold under the name DELRIN has been found suitable for this purpose. There is provided a lower shaft 68 on which a concave lower roller 69 is mounted for conjoint rotation with the shaft 68. Lower roller 69 is shown as made in two sections. Stations 4 and 5 have a guide rod 70 extending longitudinally of the apparatus along the back of the apparatus to progressively turn the back wall of the gutter body in toward the front wall. Station 5 has a front roller 71 like front roller 78 described hereinafter supported for rotation along a vertical axis which engages the ogee curve to progressively turn the front wall of the gutter body toward the back wall.

Referring now to FIG. 8 station 6 is shown to have a spherical upper roller 75 constructed and mounted like roller 65 as above described and a concave lower roller 76 mounted on a lower shaft (not shown). A rear roller 77 having a tapered peripheral surface turns the back wall toward the front wall and a front roller 78 having a semi-circular peripheral surface turns the front wall toward the back wall.

In forming the gutter, beginning at station 4 and through station 7 each succeeding station toward the exit end 19 has a upper roller with progressively smaller radius to gradually form the semi-circular or half-round shape in the bottom wall of the gutter. At the same time the ogee shape and the hook are also formed along opposite side edges of the sheet metal to form the top edges of the gutter.

The side roller assembly A shown in FIGS. 9, 10 and 11 is provided to finish bending the gutter head and further serves to grip the gutter head on the front wall as it is moved toward the back wall. The side roller assembly A is box-like in that it includes a box-like support frame 80 having a top plate 81, front plate 82 and bottom plate 83 connected in a rigid C-shaped configuration. A plurality or series of four side roller sets are each mounted for rotation about a substantially vertical axis. Referring to the first side roller set (FIG. 1), there is shown a front roller 85 that has an intermediate section 86 having a smaller diameter that bears against the front section of the head, a curved bottom section 87 that bears against the upper part of the ogee curve of the gutter body and an inclined top section 88 that bears against the top section of the gutter body. The rear roller 89 of the set is of uniform diameter and is opposite the intermediate section 86 for bearing against the inside of the front section of the gutter body. Each succeeding next two roller sets are similar to roller 85 but has a greater angle for the inclined top section so as to progressively form the head to its final shape. The fourth front roller set shown in FIG. 9 is carried by the bottom plate 83 to move therewith and has a front roller 85*a* and a rear roller 89*a*. A top roller 100*a* rotates about a horizontal axis to form the top section of the gutter.

The side roller assembly A is adjustably movable from side to side or laterally at the front and rear so that the assembly A and associated rollers are moved in at a selected angle about three to eight and preferably about 5 degrees as viewed from the top to converge the top edge of the front wall toward the rear wall. A front pusher bolt 91 and a rear pusher bolt 92 for this adjustment. The assembly A is also adjustably movable vertically or up and down so as to tilt the rollers at an inturned angle such as about three to eight and preferably five degrees to further move the top edge of the gutter in. The box sets on a base 93 into which three thumb screws 94 thread for this adjustment.

Referring now to FIGS. 5 and 9 the hook forming assembly B shown is of a conventional type having a series of three roller sets (two shown from the top) mounted to form the hook in the back wall. Referring to the last roller set shown in FIG. 9 there is provided a back roller 105 and a front roller 106 mounted on shafts to rotate about vertical axes with complimentary tapered or angled peripheral surfaces and a top roller 107 of uniform diameter. These rollers with the angles are positioned and shaped to gradually bring the top edge of the back wall toward the front wall. Assembly B is adjustably movable side to side and up or down as required. The two assemblies A and B work in conjunction with one another to balance the opposed top edges of the half-round gutter which has a tendency to slip.

Referring now to station 9 there is shown an upper roller 96 center mounted from above on a support member 95 like roller 65 above described and a concave lower roller 97. The upper roller 96 has two semi-spherical roller sections 96*a* and 96*b* mounted for free rotation in bearings and tilted in at an angle to a vertical center line through the depending support member 95 of about 14 degrees to the vertical and this eliminates any gap between the roller sections in contact with the sheet metal in forming the curve in the bottom wall of the gutter. These upper roller sections may be made of metal. The upper rollers at stations 4, 5, 6 and 7 are shown as plastic with opposite rollers of metal. The lower rollers at stations 8 and 9 may be plastic. The use of plastic instead of metal for one of the two sets of upper and lower rollers affords resiliency or a give to the sheet metal being formed and also increases the surface contact and pulling power. A back roller 98 engages the back wall and a front roller 99 engages the ogee head. The front roller 99 is similar to front roller 85*a* and has a top roller 100*a*. Station 8 is similar to station 9 but has a back roller similar to roller 98 and no front roller assembly similar to roller assembly 99. At stations 8 and 9 the upper and lower rollers 96 and 97 are in contact with at least substantially the full extent of a semi-circular arc of 180 degrees of the bottom wall of the partially formed gutter body and this contact may extend beyond the full semi-circular arc.

The radius of the upper rollers at stations 8 and 9 are substantially smaller than the radius of the bottom wall 44 of the final gutter. In particular, the radius of the upper roller is about 20 to 25% less than the radius of the final gutter. This with the converging of the front wall past a parallel relation provides an overbend of the gutter body and holds the gutter body to a smaller size before releasing the gutter body to expand to a final gutter size. By way of illustration the width of a typical half-round gutter is 5 inches and the radius of the semi-circular section is 2⅛ inches.

From the foregoing it is apparent that the overbending technique is different from the prior art which has an upper roller with a curved peripheral surface and parallel sides that do not allow the edges of the gutter body past a parallel position and do not allow full contact of the rollers up to and past an arc of 180 degrees for the bottom wall.

Although the present invention has been described with a certain degree of particularity, it is understood that the present disclosure has been made by way of example and that changes in details of structure may be made without departing from the spirit thereof.

What is claimed is:

1. In roll forming apparatus for making gutters having a semi-circular bottom wall with a preselected final radius and substantially parallel opposed walls, the combination comprising:

initial roll forming station means including a series of spaced forming stations for gradually forming a flat sheet metal into a generally U-shaped, partially formed gutter body having a curved bottom wall having a radius substantially the same as the preselected final radius of the formed gutter and first and second opposed walls projecting away from said bottom wall and terminating in a pair of opposed edges, side roller means following said forming stations for gripping and bringing said opposed walls and edges of said gutter body toward one another, at least one over bending forming station following said side roller means, said over bending forming station including a generally spherical upper roller, a generally concave lower roller opposite said upper roller, and opposed first and second wall bending means on opposite sides of said upper and lower rollers, said upper and lower rollers being shaped and sized for bending that portion of said gutter body that finally forms the bottom wall to a smaller radius than said preselected final radius whereby the elasticity of the sheet metal causes said bottom wall to expand to said preselected final radius after leaving said overbending forming station, said wall bending means turning said first and second opposed walls and edges of said gutter body toward one another past a parallel relation to a converging relation, whereby the elasticity of the sheet metal causes said bottom wall and said opposed walls to expand back to the preselected final size and shape, said side roller means including a box-like side roller assembly including a series of sets of opposed inner and outer side rollers arranged to rotate about a vertical axis, each outer side set roller having a section for gradually bending a head and for bringing an associated one wall toward the opposite wall and a hook forming assembly opposite said side roller assembly including a series of sets of opposed side rollers for progressively forming a hook in the other opposed wall and bringing said hook toward said head.

2. In roll forming apparatus as set forth in claim 1 wherein each outer side roller includes a straight section for engaging said head, a curved section for engaging an ogee curve and an inclined section for engaging a top section of the gutter body.

3. In roll forming apparatus as set forth in claim 1 wherein said overbending forming station has a side roller arranged to rotate about a vertical axis to engage and turn one opposed wall and edge toward the other.

4. In roll forming apparatus as set forth in claim 1 wherein the last of said overbending forming stations has a side roller assembly including a pair of opposed side rollers arranged to grip a side section of a head of the gutter body and a top roller arranged to engage a top section of said head.

5. In roll forming apparatus as set forth in claim 4 wherein said side rollers have complementary tapered peripheral surfaces.

6. In roll forming apparatus for making gutters having a semi-circular bottom wall with a preselected final radius and substantially parallel opposed walls, the combination comprising:

initial roll forming station means including a series of spaced forming stations for gradually forming a flat sheet metal into a generally U-shaped, partially formed gutter body having a curved bottom wall having a radius substantially the same as the preselected final radius of the formed gutter and first and second opposed walls projecting away from said bottom wall and terminating in a pair of opposed edges, side roller means following said forming stations for gripping and bringing said opposed walls and edges of said gutter body toward one another, at least one over bending forming station following said side roller means, said over bending forming station including a generally spherical upper roller, a generally concave lower roller opposite said upper roller, and opposed first and second wall bending means on opposite sides of said upper and lower rollers, said upper and lower rollers being shaped and sized for bending that portion of said gutter body that finally forms the bottom wall to a smaller radius than said preselected final radius whereby the elasticity of the sheet metal causes said bottom wall to expand to said preselected final radius after leaving said overbending forming station, said wall bending means turning said first and second opposed walls and edges of said gutter body toward one another past a parallel relation to a converging relation, whereby the elasticity of the sheet metal causes said bottom wall and said opposed walls to expand back to the preselected final size and shape, said upper roller and said lower roller at said over bending forming station being in contact with substantially the full extent of at least an arc of about 180 degrees of said bottom wall of said gutter body.

7. In roll forming apparatus as set forth in claim 6 wherein the radius of said upper roller and opposed concavity of said lower roller is about 20 to 25% less than the radius of the bottom wall of said final gutter.

8. In roll forming apparatus for making gutters having a semi-circular bottom wall with a preselected final radius and substantially parallel opposed walls, the combination comprising:

initial roll forming station means including a series of spaced forming stations for gradually forming a flat sheet metal into a generally U-shaped, partially formed gutter body having a curved bottom wall having a radius substantially the same as the preselected final radius of the formed gutter and first and second opposed walls projecting away from said bottom wall and terminating in a pair of opposed edges, side roller means following said forming stations for gripping and bringing said opposed walls and edges of said gutter body toward one another, at least one over bending forming station following said side roller means, said over bending forming station including a generally spherical upper roller, a generally concave lower roller opposite said upper roller, and opposed first and second wall bending means on opposite sides of said upper and lower rollers, said upper and lower rollers being shaped and sized for bending that portion of said gutter body that finally forms the bottom wall to a smaller radius than said preselected final radius whereby the elasticity of the sheet metal causes said bottom wall to expand to said preselected final radius after leaving said overbending forming station, said wall bending means turning said first and second opposed walls and edges of said gutter body toward one another past a parallel relation to a converging relation, whereby the elasticity of the sheet metal causes said bottom wall and said opposed walls to expand back to the preselected final size and shape, said upper roller being mounted on a central depending support member, a central shaft extending out from opposite sides of a lower end portion of said depending support member, said upper roller being provided by a pair of opposed, generally semi-spherical roller sections mounted on associated bearings carried by said shaft for free rotation relative to said support member.

9. In roll forming apparatus for making gutters having a semi-circular bottom wall with a preselected final radius and substantially parallel opposed walls, the combination comprising:

initial roll forming station means including a series of spaced forming stations for gradually forming a flat sheet metal into a generally U-shaped, partially formed gutter body having a curved bottom wall having a radius substantially the same as the preselected final radius of the formed gutter and first and second opposed walls projecting away from said bottom wall and terminating in a pair of opposed edges, side roller means following said forming stations for gripping and bringing said opposed walls and edges of said gutter body toward one another, at least one over bending forming station following said side roller means, said over bending forming station including a generally spherical upper roller, a generally concave lower roller opposite said upper roller, and opposed first and second wall bending means on opposite sides of said upper and lower rollers, said upper and lower rollers being shaped and sized for bending that portion of said gutter body that finally forms the bottom wall to a smaller radius than said preselected final radius whereby the elasticity of the sheet metal causes said bottom wall to expand to said preselected final radius after leaving said overbending forming station, said wall bending means turning said first and second opposed walls and edges of said gutter body toward one another past a parallel relation to a converging relation, whereby the elasticity of the sheet metal causes said bottom wall and said opposed walls to expand back to the preselected final size and shape, an intermediate group of said initial roll forming station means having an upper roller mounted on a central depending support member, a central shaft extending out from opposite sides of a lower end portion of said depending support member, said upper roller being provided by a pair of opposed, generally semi-spherical roller sections mounted on associated bearings carried by said shaft for free rotation relative to said support member and a gap between said roller sections for rotation of said roller sections on opposite sides of a vertical center line about a horizontal axis.

10. In roll forming apparatus as set forth in claim 9 wherein said roller sections have a surface made of a plastic material to provide resiliency and increased pulling power.

11. In roll forming apparatus for making half-round gutters having a semi-circular bottom wall with a preselected final radius and substantially parallel opposed walls, the combination comprising:

a support frame, initial roll forming station means in said support frame including a series of spaced forming stations for gradually forming a flat sheet metal into a generally U-shaped, partially formed gutter body having a curved bottom wall having a radius substantially the same as the preselected final radius of the formed gutter and opposed front and rear walls projecting away from said bottom wall with said front wall shaped as an ogee curve and having a head terminating in a first top edge and said rear wall having an inturned hook terminating in a second top edge opposite said first top edge, side roller means following said forming stations including a box-like side roller assembly mounted to said support frame for gripping said head and bending the front wall toward the rear wall and forming said head and a hook forming assembly opposite said side roller assembly for stabilizing said gutter body and forming said hook in said back wall, a pair of successive over bending forming stations following said side roller means, the last of said over bending forming station including a generally spherical upper roller, a generally concave lower roller opposite said upper roller, and opposed front and rear wall bending means, said upper and lower rollers being shaped and sized for bending bottom wall to a smaller radius than said preselected final radius whereby the elasticity of the sheet metal causes said bottom wall to expand to said preselected final radius after leaving said overbending forming station said front and rear wall bending means turning said front and rear walls and associated top edges inwardly toward one another past a parallel relation to a converging relation, whereby the elasticity of the sheet metal causes said bottom wall and said opposed walls to expand back to a preselected final size and shape, said side roller assembly being laterally adjustable at a front end that is an upstream end in relation to sheet metal movement and laterally adjustable at a rear end that is a downstream end in relation to sheet metal movement and turned at a selected angle front to rear to move the associated wall with the head toward the opposed wall.

12. In roll forming apparatus as set forth in claim 11 wherein said side roller assembly is adjustably mounted to tilt in at the top with respect to the bottom to move the associated front wall toward the opposed rear wall.

13. In roll forming apparatus for making half-round gutters having a semi-circular bottom wall with a preselected final radius and substantially parallel opposed walls, the combination comprising:

a support frame, initial roll forming station means in said support frame including a series of spaced forming stations for gradually forming a flat sheet metal into a generally U-shaped, partially formed gutter body having a curved bottom wall having a radius substantially the same as the preselected final radius of the formed gutter and opposed front and rear walls projecting away from said bottom wall with said front wall shaped as an ogee curve and having a head terminating in a first top edge and said rear wall having an inturned hook terminating in a second top edge opposite said first top edge, side roller means following said forming stations including a box-like side roller assembly mounted to said support frame for gripping said head and bending the front wall toward the rear wall and forming said head and a hook forming assembly opposite said side roller assembly for stabilizing said gutter body and forming said hook in said back wall, a pair of successive over bending forming stations following said side roller means, the last of said over bending forming station including a generally spherical upper roller, a generally concave lower roller opposite said upper roller, and opposed front and rear wall bending means, said upper and lower rollers being shaped and sized for bending bottom wall to a smaller radius than said preselected final radius whereby the elasticity of the sheet metal causes said bottom wall to expand to said preselected final radius after leaving said overbending forming station said front and rear wall bending means turning said front and rear walls and associated top edges inwardly toward one another past a parallel relation to a converging relation, whereby the elasticity of the sheet metal causes said bottom wall and said opposed walls to expand back to a preselected final size and shape.

14. In roll forming apparatus for making gutters, the combination comprising:

initial roll forming station means including a series of spaced forming stations for gradually forming a flat sheet metal into a generally U-shaped, partially formed gutter body having a curved bottom wall and first and second opposed walls projecting away from said bottom wall and terminating in a pair of opposed edges, side roller means following said forming stations for gripping and bringing said opposed walls and edges of said gutter body toward one another, at least one over bending forming station following said side roller means, said over bending forming station including a generally spherical upper roller, a generally concave lower roller opposite said upper roller, and opposed first and second wall bending means on opposite sides of said upper and lower rollers, said upper and lower rollers being shaped and sized for curving said bottom wall of said gutter body to a radius smaller than a preselected radius for a final gutter, said wall bending means turning said first and second opposed walls and edges of said gutter body toward one another past a parallel relation to a converging relation, whereby the resiliency of the sheet metal causes said bottom wall and said opposed walls to expand back to a preselected size and shape for a final gutter, said upper roller being mounted on a central depending support member, a central shaft extending out from opposite sides of a lower end portion of said depending support member, said upper roller being provided by a pair of opposed, generally semi-spherical roller sections mounted on associated bearings carried by said shaft for free rotation relative to said support member, said roller sections being inclined at a selected angle to a vertical center line of the support member with substantially no gap between said roller sections where said roller sections engage said bottom wall of said gutter body.

* * * * *